US011551562B2

(12) United States Patent
Shu-Zhong Cabos et al.

(10) Patent No.: US 11,551,562 B2
(45) Date of Patent: Jan. 10, 2023

(54) EFFICIENT FLIGHT PLANNING FOR REGIONS WITH HIGH ELEVATION TERRAIN

(71) Applicant: THE BOEING COMPANY, Chicago, IL (US)

(72) Inventors: Ralf Rene Shu-Zhong Cabos, Hainburg (DE); Nils Kneuper, Bergkamen (DE)

(73) Assignee: The Boeing Company, Chicago, IL (US)

( * ) Notice: Subject to any disclaimer, the term of this patent is extended or adjusted under 35 U.S.C. 154(b) by 54 days.

(21) Appl. No.: 16/874,308

(22) Filed: May 14, 2020

(65) Prior Publication Data

US 2021/0358312 A1 Nov. 18, 2021

(51) Int. Cl.

| | |
|---|---|
| ***G08G 5/00*** | (2006.01) |
| ***G08G 5/02*** | (2006.01) |
| ***G08G 5/04*** | (2006.01) |

(52) U.S. Cl.

CPC ..... *G08G 5/0039* (2013.01); *G08G 5/0086* (2013.01); *G08G 5/0091* (2013.01); *G08G 5/025* (2013.01); *G08G 5/045* (2013.01)

(58) Field of Classification Search

CPC .. G08G 5/0039; G08G 5/0086; G08G 5/0091; G08G 5/025; G08G 5/045

USPC ..... 701/18

See application file for complete search history.

(56) References Cited

U.S. PATENT DOCUMENTS 4,774,670 A * 9/1988 Palmieri ..... G05D 1/101 701/3
5,842,142 A 11/1998 Murray et al.
6,134,500 A * 10/2000 Tang ..... G06Q 10/047 701/10
8,073,578 B1 * 12/2011 McCusker ..... G08G 5/0034 701/3

(Continued)

FOREIGN PATENT DOCUMENTS

ER 2779140 A1 9/2014

OTHER PUBLICATIONS

European Patent Office, Extended European Search Report for Application 21173867.9 dated Oct. 19, 2021.

(Continued)

*Primary Examiner* — Isaac G Smith
(74) *Attorney, Agent, or Firm* — Patterson + Sherdan, LLP

(57) ABSTRACT

Certain aspects of the present disclosure provide a method for determining a flight plan for an aircraft, including: determining one or more regions that intersect an initial flight path and comprise at least one terrain feature having an elevation greater than an elevation threshold; for each respective region: determining a flight area based on the initial flight path and an elevation threshold line; determining one or more segments of the initial flight path that comprise one or more terrain features having an elevation greater than the elevation threshold; and determining a modified flight path for each respective segment by: determining a plurality of descent gradients along the respective segment; and moving the respective segment of the initial flight path in the safe descent direction if any of the plurality of descent gradients would collide with any of the one or more terrain features.

20 Claims, 12 Drawing Sheets

(56) References Cited

U.S. PATENT DOCUMENTS

| | | | | |
|---|---|---|---|---|
| 8,392,038 | B2 * | 3/2013 | Caillaud | G01C 23/00 701/5 |
| 8,565,944 | B1 | 10/2013 | Gershzohn | |
| 8,666,649 | B2 | 3/2014 | Otto et al. | |
| 8,700,249 | B1 | 4/2014 | Carrithers | |
| 9,081,935 | B2 | 7/2015 | Heinzerling | |
| 9,310,222 | B1 | 4/2016 | Suiter et al. | |
| 10,242,582 | B1 * | 3/2019 | Ogden | G08G 5/025 |
| 2005/0273249 | A1 * | 12/2005 | Artini | G05D 1/0646 701/120 |
| 2007/0250223 | A1 | 10/2007 | Francois et al. | |
| 2008/0109160 | A1 | 5/2008 | Sacle et al. | |
| 2008/0306680 | A1 * | 12/2008 | Marty | G08G 5/0034 701/533 |
| 2010/0070110 | A1 | 3/2010 | Badli et al. | |
| 2012/0221233 | A1 | 8/2012 | White et al. | |
| 2013/0090842 | A1 | 4/2013 | Stabile | |
| 2013/0166113 | A1 * | 6/2013 | Dakin | G01S 7/4818 701/10 |
| 2015/0151834 | A1 | 6/2015 | Cox et al. | |
| 2016/0229554 | A1 | 8/2016 | Kawalkar et al. | |
| 2016/0343262 | A1 | 11/2016 | Auletto et al. | |
| 2016/0351058 | A1 | 12/2016 | Wischmeyer et al. | |
| 2017/0221367 | A1 | 8/2017 | Kawalkar et al. | |
| 2017/0229024 | A1 | 8/2017 | Moravek et al. | |
| 2021/0082290 | A1 | 3/2021 | Kneuper et al. | |

OTHER PUBLICATIONS

Extended European Search Report and Written Opinion dated Dec. 17, 2020 in the corresponding European Application No. 20187202.5.

* cited by examiner

EFFICIENT FLIGHT PLANNING FOR REGIONS WITH HIGH ELEVATION TERRAIN

INTRODUCTION

Aspects described herein relate to systems and methods for determining more efficient flight plans while maintaining safe descent options when flying over or near high elevation terrain features.

Conventional flight planning systems avoid plotting flight paths over or near high elevation terrain features to reduce the risk posed by such terrain features in the event of an unplanned descent, such as in the case of a rapid descent in response to an unexpected cabin depressurization event. This is because it is generally desirable to descend as quickly as possible to a safe altitude and then to land at a nearby airport and high elevation terrain features may frustrate those objectives. Consequently, flight paths in regions with high elevation terrain features tend to be longer and less direct, which significantly impacts the efficiency of flight operations. For example, longer flight paths mean increased fuel use and increased wear on aircraft components, which lead to overall higher operating costs, higher environmental impacts, and less availability of aircraft for operations. Further, longer flight paths mean longer flight times for customers, which leads to lower satisfaction.

Accordingly, improved systems and methods for determining more efficient flight plans while maintaining safe descent options when flying over or near high elevation terrain features are needed.

BRIEF SUMMARY

In a first aspect, a method for determining a flight plan from an origin to a destination for an aircraft, includes: determining one or more regions that intersect an initial flight path and comprise at least one terrain feature having an elevation greater than an elevation threshold; for each respective region in the one or more regions: determining a flight area within the respective region based on the initial flight path and an elevation threshold line, wherein the elevation threshold line indicates a portion of the respective region in which all terrain is below the elevation threshold in a safe descent direction for the respective region; determining one or more segments of the initial flight path in the respective region that comprise one or more terrain features having an elevation greater than the elevation threshold; and determining a modified flight path for each respective segment of the one or more segments of the initial flight path in the respective region by: determining a plurality of descent gradients from a plurality of positions along the respective segment and from an estimated cruise altitude to an altitude threshold based on an estimated descent time from the estimated cruise altitude to the altitude threshold; and moving the respective segment of the initial flight path in the safe descent direction if any of the plurality of descent gradients would collide with any of the one or more terrain features along the respective segment, wherein the modified flight path for the respective region is between the initial flight path and the elevation threshold line within the flight area of the respective region.

Other aspects provide processing systems configured to perform the aforementioned methods as well as those described herein; non-transitory, computer-readable media comprising instructions that, when executed by one or more processors of a processing system, cause the processing system to perform the aforementioned methods as well as those described herein; a computer program product embodied on a computer readable storage medium comprising code for performing the aforementioned methods as well as those further described herein; and a processing system comprising means for performing the aforementioned methods as well as those further described herein.

BRIEF DESCRIPTION OF THE DRAWINGS

The appended figures depict aspects of the one or more embodiments and are therefore not to be considered limiting of the scope of this disclosure.

To facilitate understanding, identical reference numerals have been used, where possible, to designate identical elements that are common to the drawings. It is contemplated that elements and features of one embodiment may be beneficially incorporated in other embodiments without further recitation.

DETAILED DESCRIPTION

Figure 1:
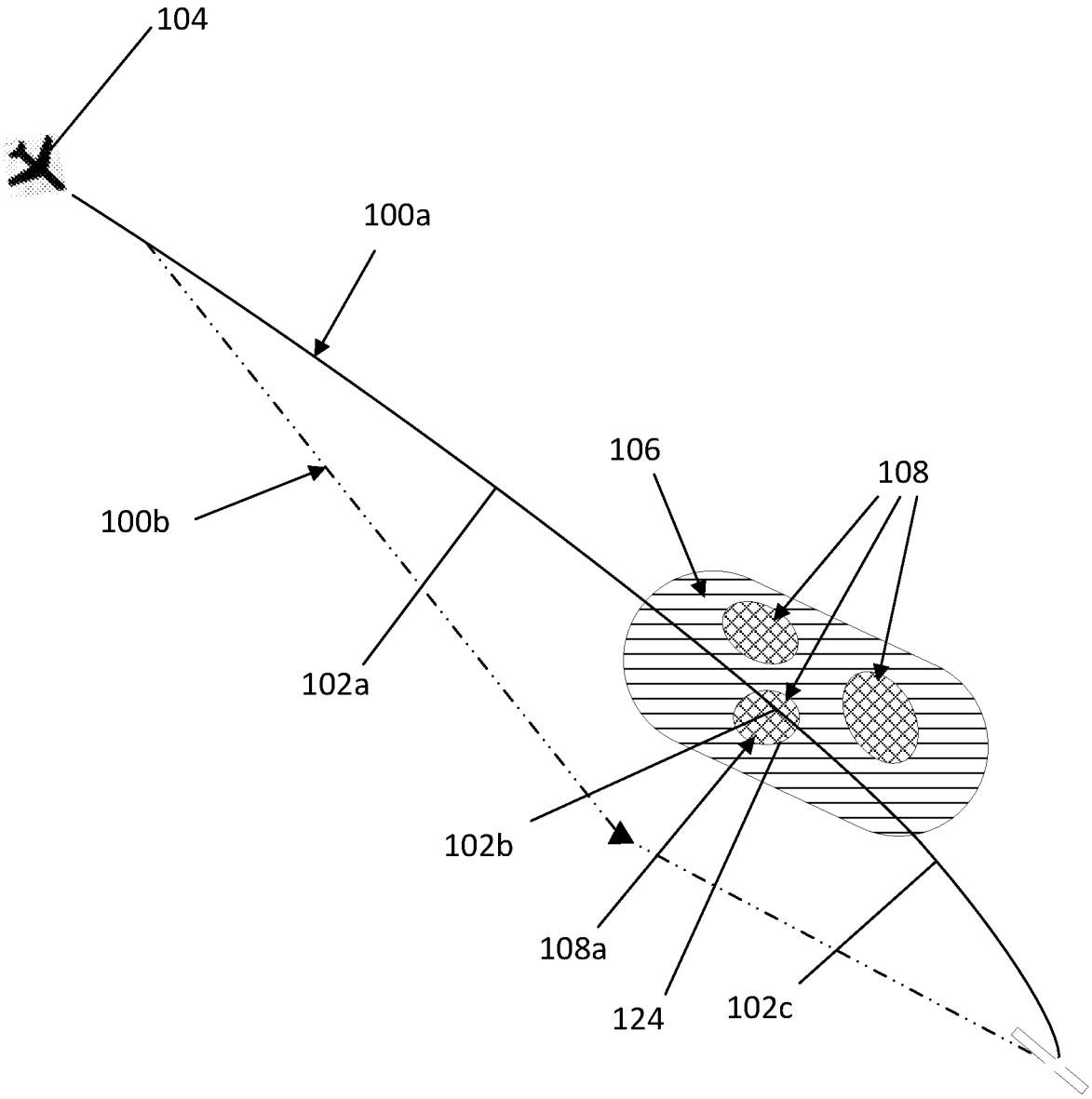
FIG. 1 depicts an initial flight path traversing through a region of interest and over a high terrain region.

Aspects of the present disclosure provide systems and methods for determining more efficient flight plans while maintaining safe descent options when flying over or near high elevation terrain features.

A flight plan is generally a plan filed by a pilot or flight dispatcher with a local Air Navigation Service Provider (e.g. the FAA in the United States) prior to departure which indicates an aircraft's planned route or flight path in addition to other information. In some cases, a flight plan may be formatted according to a specific standard, such as in International Civil Aviation Organization (ICAO) Doc 4444. Flight plans may generally include information such as departure and arrival points, flight path between the departure and arrival points, estimated time en route, alternate airports in case of bad weather, type of flight (e.g., instrument flight rules (IFR) or visual flight rules (VFR)), pilot information, number of people on board, and information about the aircraft itself, to name a few examples. In some cases, a flight path of a flight plan may include a list of waypoints (e.g., defined by latitude and longitude) that an aircraft is meant to traverse in a sequence as part of the flight plan.

Routing types used in flight planning may include, for example, airway, navaid and direct, and a flight path may be composed of segments of different routing types. Airway routing may generally occur along pre-defined pathways, which are akin to three-dimensional highways for aircraft, and which include rules governing airway routing cover altitude, airspeed, and requirements for entering and leaving the airway. Navaid routing occurs between navigational aids, which are not always connected by airways. Direct routing occurs when one or both of the route segment endpoints are at a latitude/longitude which is not located by a navigation aid.

Conventional flight planning steers clear of high elevation terrain features to ensure aircraft may easily perform a rapid descent to a safe altitude from any point along the flight path in the event of an unexpected flight issue, such as a rapid cabin decompressions. However, unnecessarily indirect flight paths result in increased fuel use, increased wear on aircraft components, higher operating costs, higher environmental impacts, and less availability of aircraft for operations, to name a few. Conventional flight planning also uses a static list of airports to be used in the event of an emergency landing.

Embodiments described herein improve upon conventional flight planning methods by considering a wide range of factors in order to plan more efficient and equally safe flight paths. For example, embodiments described herein consider operational characteristics of different aircraft (e.g., maximum descent speed, maximum speed over ground, etc.), current wind conditions in regions with high elevation terrain features, and others to generate more direct and therefore efficient flight paths.

More specifically, embodiments described herein may start with a most direct flight path between an origin and a destination. In some cases, the most direct flight path may be a great circle flight path between the origin and destination, however in other cases the most direct flight path may have diversions to avoid regions for specific reasons, such as political, weather related, or the like. A great circle flight path is the shortest distance between two points on the surface of a sphere.

Embodiments described herein then identify segments along the most direct flight path that traverse high elevation terrain regions, which may include, for example, high elevation terrain features (e.g., features having an elevation above a certain threshold, such as 10,000 feet). In some cases the elevation threshold may be an absolute threshold, such as a region containing a terrain feature (e.g., a mountain peak) having an elevation above the threshold. In other cases, the elevation threshold may be chosen based on a minimum obstacle clearance above any terrain feature. For example, with a minimum obstacle clearance is 2,000 feet and elevation threshold of 10,000 feet, any terrain feature above 8,000 feet would exceed the elevation threshold including the minimum obstacle clearance (e.g., 8,001 feet of elevation+2,000 feet minimum obstacle clearance=10,001 feet).

For each identified segment, a flight area may be determined based on the initial flight path, a safe descent direction, and an elevation threshold line. Then, an optimized flight path may be determined within the flight area for the segment by considering possible descent gradients, known terrain features, aircraft performance, and local weather. The resulting modified flight paths maintain the safety attributes of conventional flight planning while allowing for a modified flight plan that is significantly more efficient than a conventional flight plan, which might avoid the region of high terrain entirely.

Accordingly, the systems and methods described herein improve upon conventional flight planning methods by calculating descent gradients for a plurality of positions along each segment using information specific to the aircraft and the weather. If all descent gradients do not collide with a terrain feature or infringe a minimum obstacle clearance threshold (as discussed in FIG. 2A) then the segments are moved closer to the great circle flight path (which may traverse the high terrain region) and the process is repeated. If at least one descent gradient collides with a terrain feature or infringes a minimum obstacle clearance threshold, then the segments are moved away from the great circle flight path. This iterative process brings the flight path as close as possible to high elevation terrain features while ensuring a safe flight plan and results in a shorter flight path than conventional methods.

Furthermore, embodiments described herein improve upon conventional flight planning methods by using information about nearby airports, such as runway lengths and weather on site, to determine suitable emergency destinations in the event the aircraft must land while in flight. Emergency destinations are determined for each descent gradient and may be updated while in flight.

Examples of Flight Paths over or Near High Elevation Terrain Features

FIG. 1 depicts an initial flight path 100*a* for an aircraft 104 traversing through a region of interest 106 and over a high terrain region 108*a*. In this example, region of interest 106 is represented as a projection on a map having high terrain regions 108, wherein the high terrain regions 108 include one or more features above an elevation threshold, which is described further with respect to FIG. 2A (e.g., elevation at or above elevation threshold 212). High terrain regions 108 are bounded by an elevation threshold line 124 marking the beginning of the elevation threshold. For example, elevation threshold line 124 marks the bounds of high terrain region 108*a*. Thus, the elevation threshold line (e.g., 124) is fixed for each high terrain region (e.g., 108) based on the threshold value (e.g., 10,000 feet).

Flight path 100*a* may be initially generated as the most direct route between an origin and destination point. In some cases, the initial flight path 100*a* may be as close as possible to the actual shortest path between an origin and destination, such as approximated by a great circle path. However, given airway structures, winds, overflight charges differing over every country, and other factors, the initial flight path may often deviate from the great circle path. In this example, initial flight path 100*a* traverses a region of interest 106 and flies over a high terrain region 108*a*.

Conventional flight planning methods avoid region of interest 106 altogether in order to avoid the regions of high terrain (e.g., 108) within region of interest 106. For example, flight path 100*b* shows an example of a flight path generated according to conventional methods. Unlike conventional methods, and as described further herein, initial flight path 100*a* may be modified to safely traverse region of interest 106 and fly over or near high terrain regions 108 while maintaining the same safety margins as flight path 100*b*. In some embodiments, as described further below, initial flight path 100*a* may be decomposed into segments, some of which may be moved during flight planning to safely navigate region of interest 106 without having to fly completely around it, as with flight path 100*b*.

For example, initial flight path 100*a* may be broken into segments based on each intersection of flight path 100*a* with a high terrain region (e.g., 108*a*). Thus, in this example, a first segment 102*a* of initial flight path 100*a* starts outside region of interest 106 and terminates where flight path 100*a* intersects elevation threshold line 124. Then, a second segment 102*b* is defined as the portion of flight path 100*a* between the end of segment 102*a* and where flight path 100*a* again intersects elevation threshold line 124. Next, a third segment 102*c* is defined as the portion of flight path 100*a* between the end of segment 102*b* and ends outside of region of interest 106 at the final destination. Notably, this is just one example, and segments may be defined in alternative manners in other examples such as more than one segment per each high terrain region or additional segments starting and/or terminating at the intersection with region of interest. In some embodiments, segments may only be defined inside regions of interest that intersect initial flight plans Once decomposed into segments, various segments of initial flight path 100*a* may be modified for safety. As discussed above, conventional flight planning may avoid region 106 altogether (e.g., by flying route 100*b*), which would significantly extend the flight path and therefore the time in flight, fuel usage, and the like. By contrast, embodiments described herein may adjust segments of initial flight path 100*a* within region of interest 106 and/or regions of high terrain 108 to minimize risk from high elevation terrain features (e.g., 108*a*). The ability to fly over such regions results in using shorter flight paths than conventional flight plans (e.g., 100*b*), which beneficially decreases operating costs, lowers environmental impacts, and increases availability of aircraft for operations. FIGS. 3-10 describe various aspects of the improve flight planning in greater detail.

Determining Safe Descent Gradients for Flight Paths

As described briefly above, one aspect of creating safe flight plans is to determine safe descent directions for various regions of the flight path. For example, in a region with high elevation terrain features to the north of a flight path, the safe descent direction may be in a southerly direction. This is because an emergency or otherwise unplanned descent is preferably performed as fast as possible and as safely as possible, and a high elevation terrain feature in an area of a flight path may create a hazard during such a descent.

Figure 2A:
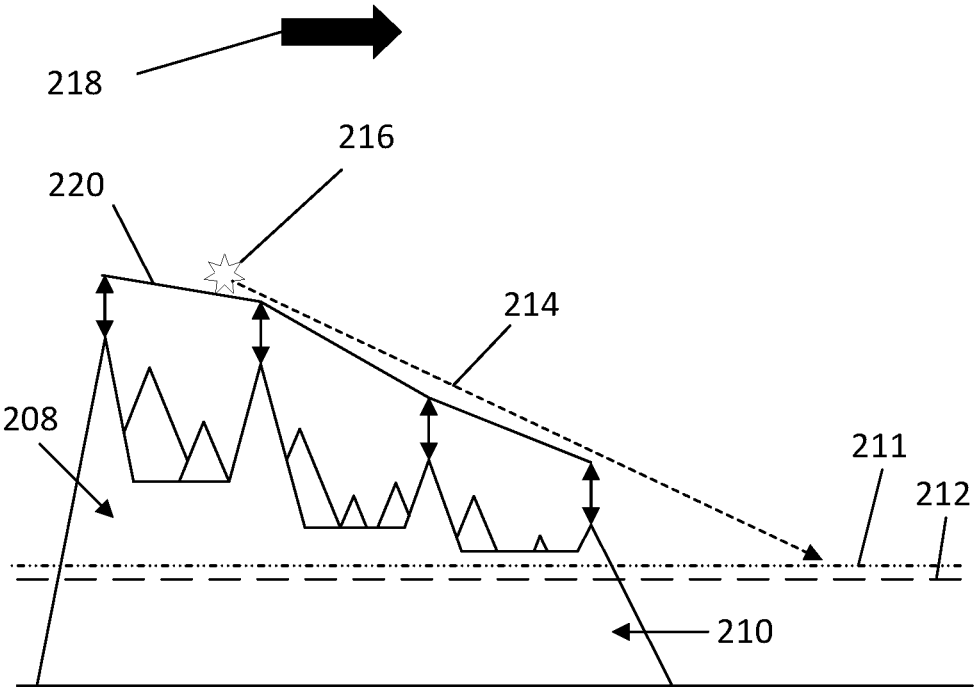
FIG. 2A depicts a view of a descent gradient from the cruising altitude to altitude threshold over high terrain region.
Figure 2B:
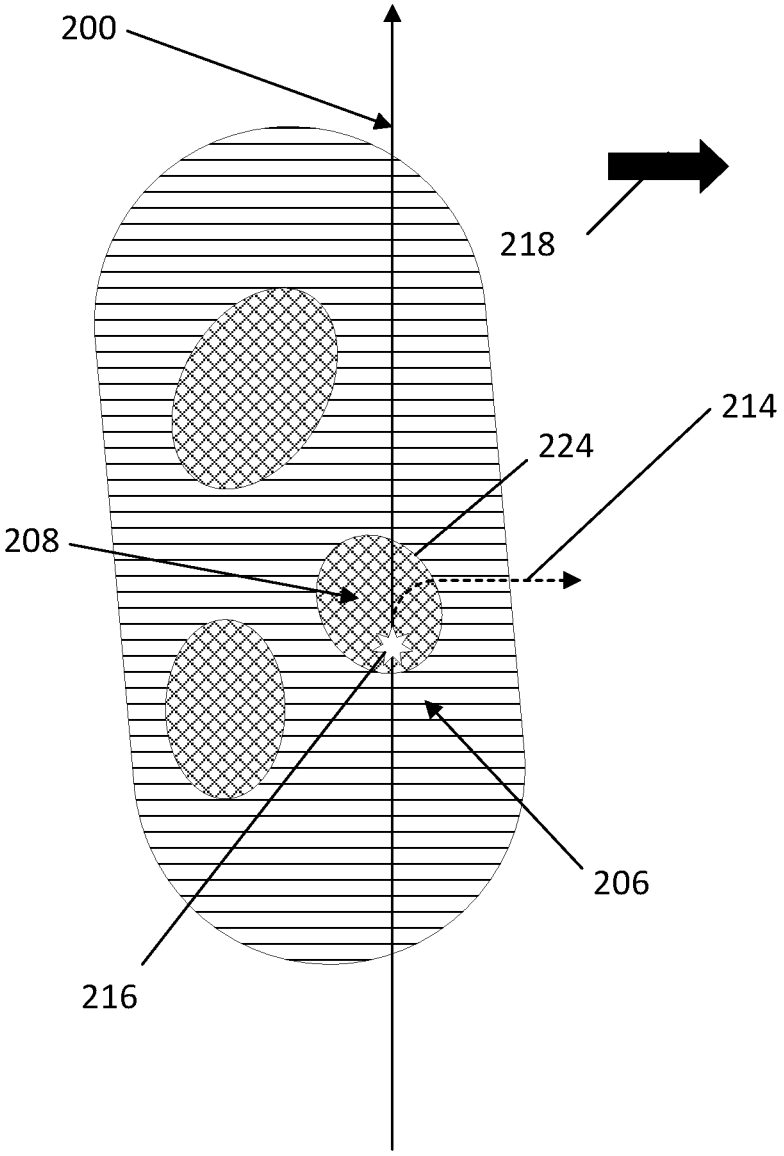
FIG. 2B is a top view of FIG. 2A and depicts descent gradient traversing high terrain region to an altitude threshold.

FIGS. 2A and 2B depict different views of a descent gradient 214 traversing a high terrain region 208 to an altitude threshold 211. High terrain region 208 is a region comprising terrain features 210 above an elevation threshold 212.

A descent gradient is generally a three-dimensional path from a first altitude, such as a cruising altitude, to a second altitude, such as a safe altitude (e.g., altitude threshold 211). A descent gradient may be flown in the event of an unexpected event, such as an unexpected cabin depressurization, medical issue aboard the aircraft, or mechanical issue with the aircraft, to name a few examples.

In particular, FIG. 2A depicts a view of descent gradient 214 from the cruising altitude to altitude threshold 211 over high terrain region 208 (e.g., 108*a* from FIG. 1). In this example, the aircraft is flying a flight path (e.g., flight path 200 in FIG. 2B) when an unexpected event 216 occurs, such as a rapid cabin decompression, and the aircraft must make a rapid descent to altitude threshold 211.

In response to the event, the aircraft may rapidly change course and initiate a descent along descent gradient 214 to altitude threshold 211 according to a safe descent direction 218. The safe descent direction may be determined as part of the flight planning process in some embodiments, or separately in others. In some cases, the safe descent direction may be based on current flight conditions.

In this example, altitude threshold 211 is depicted above elevation threshold 212. In other examples, the altitude threshold (e.g., 211) is below or at the same altitude as the elevation threshold (e.g., 212). In some examples, altitude threshold 211 is at an altitude where atmospheric pressure is such that aircraft passengers can breathe without supplied oxygen, such as 10,000 feet above mean sea level. In one example, elevation threshold 212 is approximately 10,000 feet, but may be different elevations in other examples. As above, the elevation threshold 212 may account for a minimum obstacle clearance, such as 2,000 feet in some examples.

FIG. 2A further depicts an example of a minimum obstacle clearance line 220, which is a required minimum standoff distance from terrain features 210, such as may be set by an operator, based on aircraft characteristics, or provided by a civil aviation organization, such as ICAO. In one example, altitude threshold 211 is at an altitude that is approximately the minimum standoff distance, or minimum obstacle clearance threshold, above elevation threshold 212.

Notably, aspects of descent gradient 214, such as its slope, may vary with characteristics of the aircraft making the descent, such as the maximum safe vertical speed of aircraft, as well as with ambient conditions, such as wind direction. Generally, a maximum safe vertical speed of an aircraft is the fastest the aircraft can safely descend within a safe operating flight envelope, such as, for example, about 6,000-7,000 ft/min for certain aircraft. However, the maximum safe vertical speed will vary depending on multiple factors, including aircraft type or model, weather conditions, and others.

Figure 3:
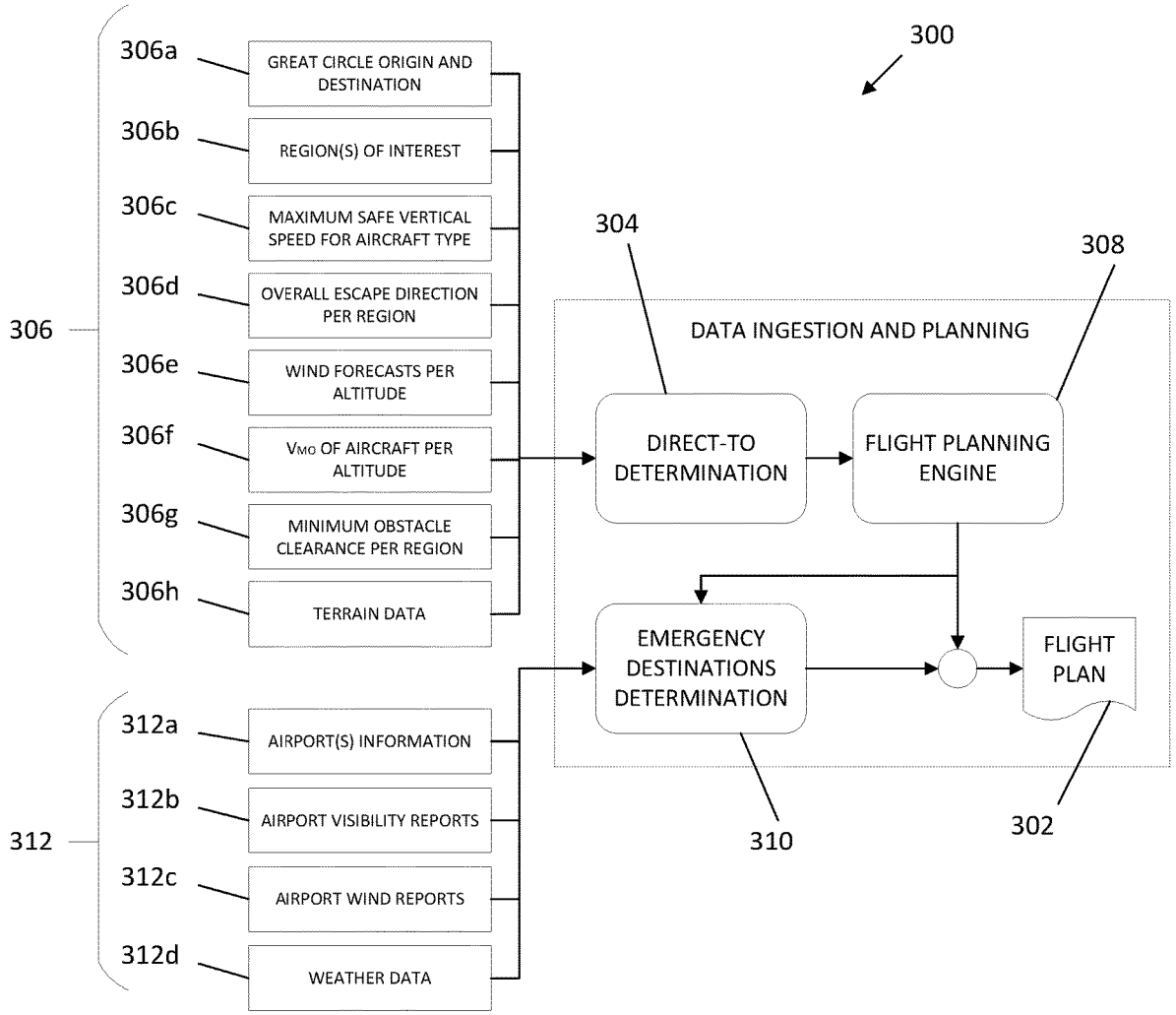
FIG. 3 depicts aspects of a system for developing a flight plan for an aircraft.
Figure 8:
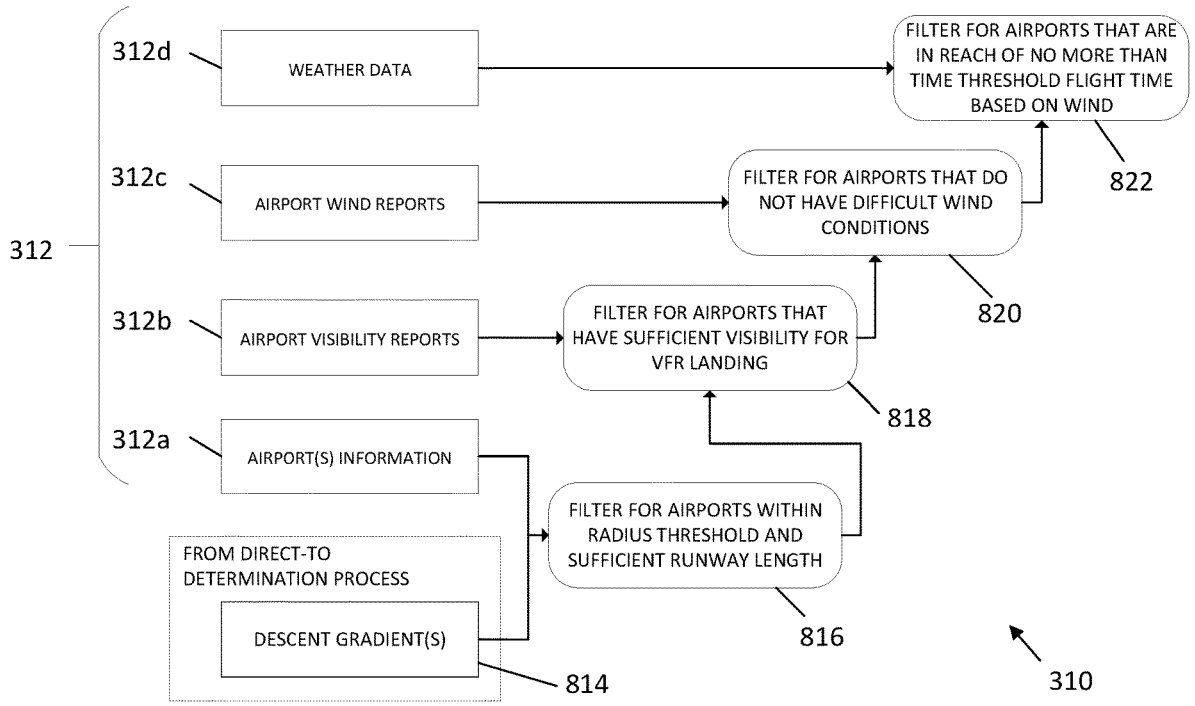
FIG. 8 depicts a flowchart of various aspects and operations of an embodiment of the emergency destinations determination subsystem from FIG. 3.
Figure 9:
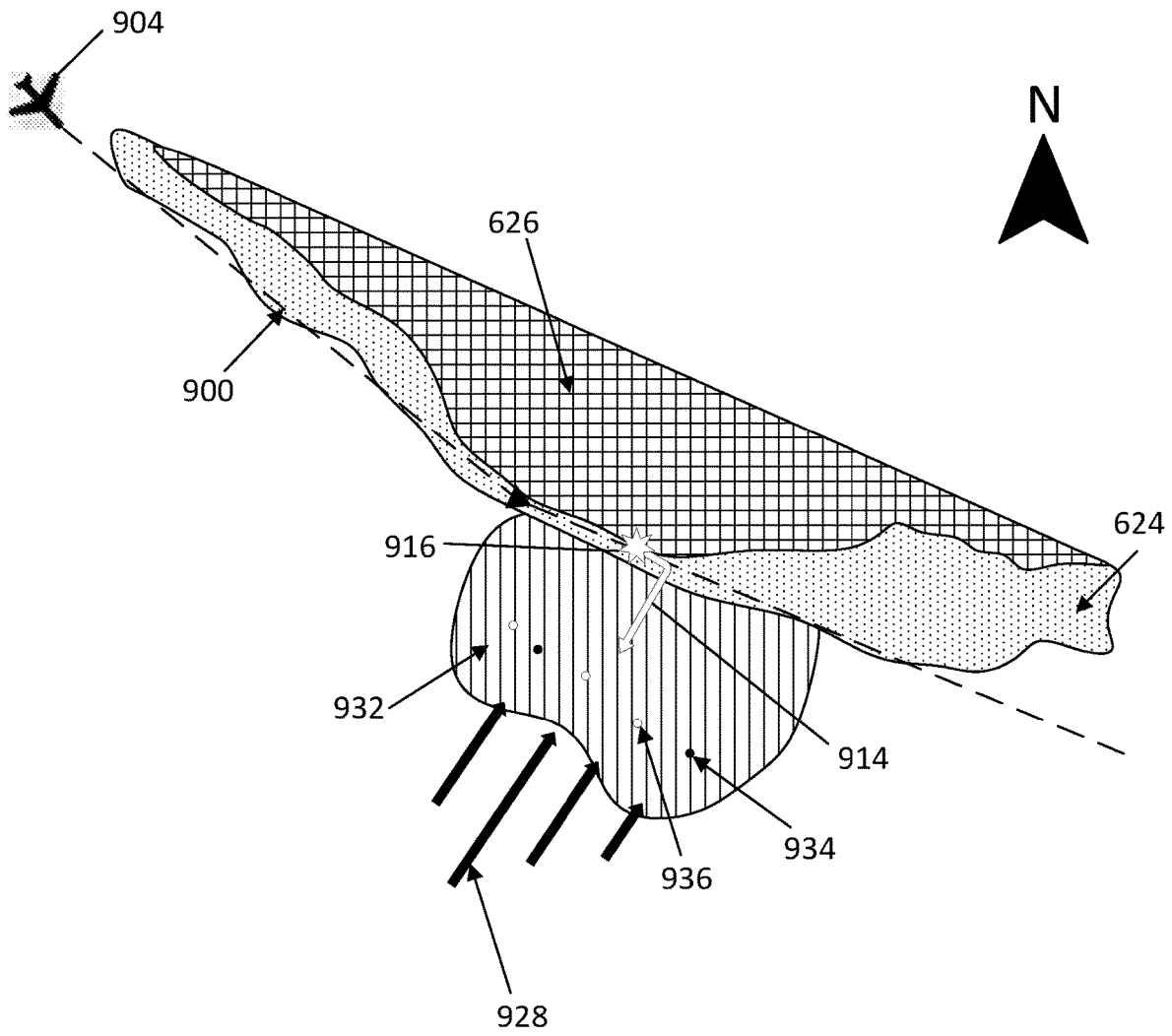
FIG. 9 depicts a flight path near high elevation terrain features with a safe descent gradient to several landing sites.

In some embodiments, once aircraft is at altitude threshold 211, an alternate or emergency landing destination may be chosen, as discussed in more detail with respect to FIGS. 3, 8, and 9.

FIG. 2B is a top view of FIG. 2A and depicts descent gradient 214 traversing high terrain region 208 inside a region of interest 206 to the altitude threshold (e.g., altitude threshold 211 from FIG. 2A). As depicted in FIG. 2B, a turn is made after unexpected event 216 along the flight path 200 in a safe descent direction 218. Elevation threshold line 224 marks the beginning of terrain features that are at the same elevation as the elevation threshold as described in FIG. 1 (e.g., elevation threshold line 124).

Example Applications for Determining Flight Plans Over or Near High Elevation Terrain Features FIG. 3 depicts aspects of a system 300 for developing a flight plan 302 for an aircraft, particularly a flight plan (e.g., 302) including a flight path traversing over or near high terrain regions, as described above. System 300 may be implemented on an apparatus used for flight planning such as a computer, phone, or tablet, or aircraft avionics, such as a flight management system. Therefore, system 300, or aspects thereof, may be implemented on-board and/or off-board the aircraft.

For example, in an off-board implementation, system 300 communicates with the aircraft over a data connection (such as a wireless ground or space-based data connection) during flight to update flight plan 302. Additionally, flight plan 302 can be modified before the aircraft takes off, while the aircraft is in flight, or both, based on emerging conditions, such as local weather.

In this example, a direct-to determination subsystem 304 uses factors affecting flight 306 to determine a flight path with safe descent gradients over high terrain regions, as described above. Then, a flight planning engine 308 subsystem generates flight plan 302 based off the flight path with safe descent gradients, and an emergency destinations determination subsystem 310 uses factors affecting landing 312 to determine suitable emergency destinations along the flight path with safe descent gradients. Suitable emergency destinations may be information included within flight plan 302 in some embodiments.

In this example, factors affecting flight 306 include great circle origin and destination 306*a*, region(s) of interest 306*b*, maximum safe vertical speed for aircraft type 306*c*, overall escape direction per region 306*d*, wind forecasts per altitude 306*e* including speed and vectors, maximum operating velocity (e.g., $V_{mo}$) of aircraft per altitude 306*f*, minimum obstacle clearance per region 306*g*, and terrain data 306*h* including elevation data. In other examples, other and additional factors may be considered.

Great circle origin and destination 306*a* is a great circle flight path, as described above, taken from an origin point to a destination point. This is a theoretical optimal flight path, but may not be feasible for several reasons including high elevation terrain features, airway structures, winds, and overflight charges which differ by country. Therefore, the great circle flight path may be used as a baseline for comparing initial flight paths.

Region(s) of interest 306*b* includes various regions that may affect flight path, such as regions with high elevation terrain, bad weather, political safety issues, and others, as described above.

Maximum safe vertical speed for aircraft type 306*c* is the fastest the aircraft can safely descend, as described above. This value will generally vary based on type or model of the aircraft, and in particular is based on performance characteristics of the aircraft, manufacturer recommended flight envelopes, and other factors.

Overall escape direction per region 306*d* is a listing of recommended directions to descend in the event of a need to rapidly descend, such as the unexpected events described above. Directions will vary by region depending on terrain or other factors influencing descent. For example, if the aircraft is flying with mountainous terrain on its left and a flat terrain on its right, the overall escape direction will likely be to the right because there are no terrain features to contend with during the descent in that direction. In one example, escape directions are predefined based on regions, including regions of interest. In other examples, they are calculated using the flight path, aircraft velocity, underlying terrain, and other data sources. Calculations can be done during flight planning or live during flight.

Wind forecasts per altitude 306*e* comprises data on wind direction and wind speed for a plurality of altitudes over time including predictions on future conditions. Data may be provided per region and per discrete altitude levels (or ranges of altitude). In some examples, wind forecasts per altitude 306*e* is initially determined during flight planning and may subsequently be updated during flight based on changing conditions.

Maximum operating velocity of aircraft per altitude 306*f* is a listing of maximum aircraft velocities per different altitudes. This value will vary based on type or model of the aircraft, similar to maximum safe vertical speed for aircraft type 306*c*.

Minimum obstacle clearance per region 306*g* is a listing of minimum standoff distances the aircraft must maintain from terrain features. Standoff distances may vary by region and generally must be observed even when performing a rapid decent.

Terrain data 306*h* is a three-dimensional data set describing the surface of Earth. Terrain data 306*h* may be used to determine regions of interest, including regions of high terrain above an elevation threshold. Further, minimum obstacle clearance thresholds may be based on terrain data 306*h* as a reference for the obstacle characteristics.

Factors affecting flight 306 may be determined before flight, during flight, or both. Factors 306*a-h* may be derived from various data sources. Notably, factors affecting flight 306*a-h* are just some examples, and other factors may be included for flight planning in other embodiments. For example, a no-fly zone data source may be used to prevent flight over restricted airspace or other areas for political reasons. In other examples, an initial flight path, which may be set by an operator or provided by a civil aviation organization, such as ICAO, is used as a starting point to determine modified flight paths, where the initial flight path is not a great circle flight path.

In this example, factors affecting landing 312 include airport(s) information 312*a*, airport visibility reports 312*b*, airport wind reports 312*c*, and weather data 312*d*.

Airport(s) information 312*a* is a listing of airports around the world including, for example, runway numbers, lengths, direction, and status. Airport information(s) 312*a* may include public and private airports, as well as military bases in some examples. Airport information(s) 312*a* can be used to determine potential emergency destinations for an aircraft if an unexpected event occurs, such as an unexpected cabin depressurization.

Airport visibility reports 312*b* include data related to visibility conditions at airports. Visibility reports may generally be provided by a data service and may be updated at some fixed interval. In some embodiments, visibility reports 312*b* may be provided as live data based on, for example, sensing systems at airports.

Airport wind reports 312*c* include data related to wind conditions at airports. For example, airport wind reports 312*c* may include wind speed, wind direction, variability, and other wind characteristics. Airport wind reports 312*c* may generally be provided by a data service and may be updated at some fixed interval. In some embodiments, airport wind reports 312*c* may be provided as live data based on, for example, sensing systems at airports.

Weather data 312*d* may include data related to weather more generally, including at and around airports. Weather data may include current and forecasted conditions, including temperature, humidity, cloud layering, and others. Weather data 312*d* can be provided through different means, including sensors on-board an aircraft, sensor reports from other aircraft, reports from air traffic control, and sensor readings from ground-based sensors that are shared with an aircraft either directly or through other channels, such as through air traffic control.

Factors affecting landing 312 may be estimated before flight and updated during flight, and may include different combinations of previously discussed data sources or additional data sources. Factors 312*a-d* may be derived from various data sources. Notably, factors 312*a-d* are just some examples, and other factors may be included for flight planning in other embodiments.

Subsystems, including direct-to determination subsystem 304 and emergency destinations determination subsystem 310, may be provided by a single system in some embodiments, or by multiple collaborating systems in other embodiments. For example, data may be exchanged through application programming interfaces (APIs) and established data channels between subsystem elements. In some embodiments, each subsystem may operate separately and independently of the others.

For example, one or more of direct-to determination subsystem 304, flight planning engine 308, and emergency destinations determination subsystem 310 may be implemented in off-board equipment, such as at an operations center for an airline. In some embodiments, one or more of the subsystems may be implemented on mobile equipment, such as laptop or tablet computers, or other computing devices that may be moved from place to place. For example, subsystems 304, 308, and 310 may be a part of an integral flight planning software suite that can be installed on a tablet computing device. In some embodiments, subsystems 304, 308, and 310 may be implemented as a client-server software system in which a server performs primary processing and a client receives data processed by the server, such as on a portable electronic device.

Example Direct-To Determination

Figure 4:
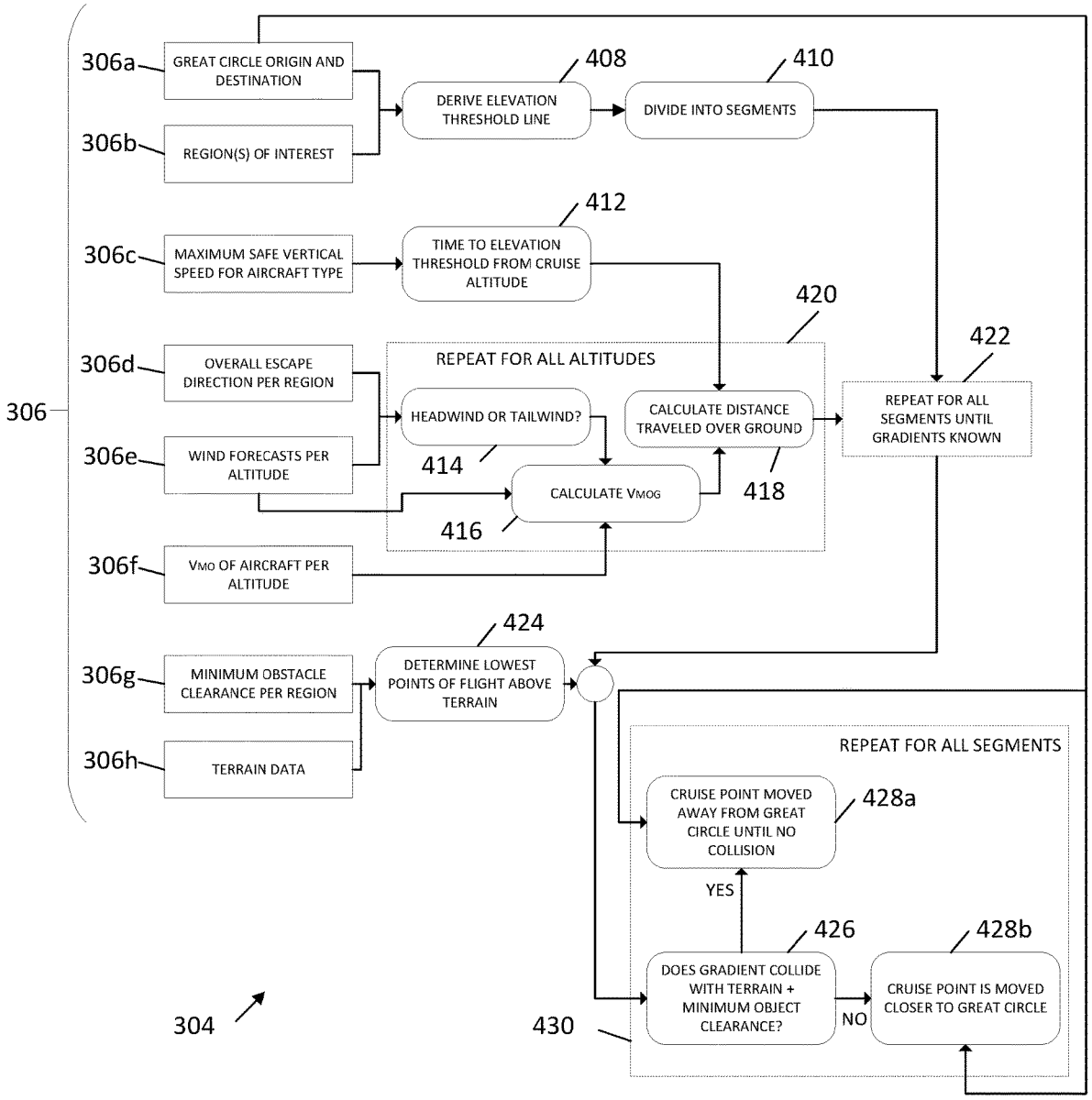
FIG. 4 depicts a flowchart of various aspects and operations of an embodiment of the direct-to determination subsystem from FIG. 3.

FIG. 4 depicts a flowchart of various aspects and operations of an embodiment of direct-to determination subsystem 304, as described with respect to FIG. 3, including inputs such as factors affecting flight 306.

In this example, step 408 uses a great circle origin and destination 306*a* flight path and region(s) of interest 306*b* to derive an elevation threshold line for a region with a terrain feature or features above an elevation threshold, such as described above (e.g., elevation threshold line 224 in FIG. 2B and high terrain regions 108 and 208 in FIGS. 1 and 2B, respectively).

Step 410 then divides great circle origin and destination 306*a* flight path over these regions into segments, whereby a new segment is created each time great circle origin and destination 306*a* flight path intersects with the elevation threshold line as described in FIG. 1. In other examples, steps 408 and 410 use a different flight path than great circle origin and destination 306*a* flight path, such as an initial flight path.

Step 412 uses maximum safe vertical speed for aircraft type 306*c* to calculate the descent time, which is the time it takes for an aircraft to descend to an altitude threshold from a cruise altitude, such as the flight path. For example, if maximum safe vertical speed for aircraft type 306*c* is 6,000 ft/min, and the vertical distance between cruise altitude and the altitude threshold is 25,000 feet, then step 412 would be about 4.17 minutes. In some examples, an estimated cruising altitude may be used based on estimated or predicted conditions such as weather, turbulence, or air traffic. Step 412 then calculates an estimated descent time. However, the actual cruise altitude may differ from the estimated cruise altitude based on actual and changing conditions during flight.

Figure 6:
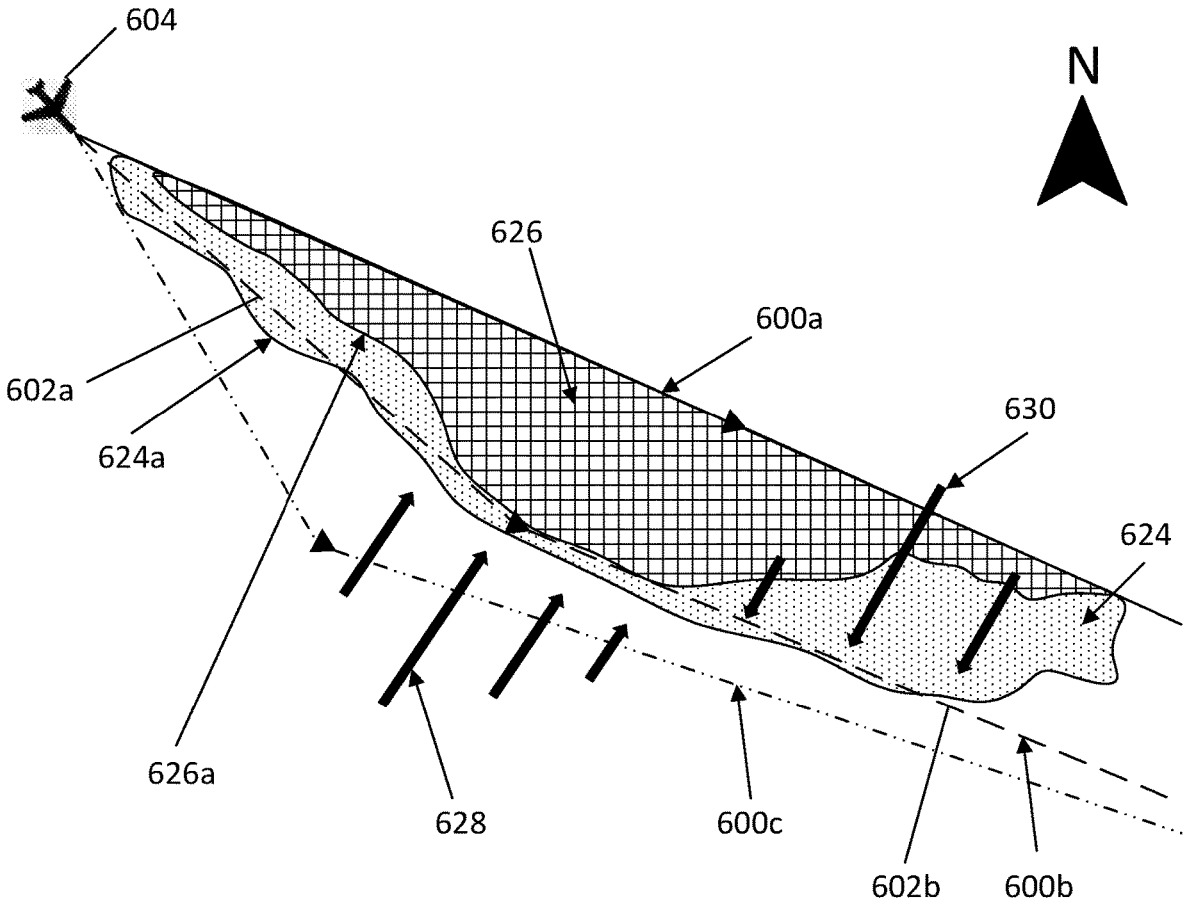
FIG. 6 depicts an overhead view of various flight paths over or near a high terrain region and presents a result of direct-to subsystem.

In this example, step 414 uses overall escape direction per region 306*d* and wind forecasts per altitude 306*e* to determine whether the aircraft is faced by a headwind or tailwind, which impacts the descent gradient as discussed in FIG. 6. For example, if overall escape direction per region 306*d* is to the south and wind forecasts per altitude 306*e* are all from south to north, then step 414 would be a headwind for all altitudes.

Step 416 uses maximum operating velocity (e.g., $V_{mo}$) of aircraft per altitude 306*f*, wind forecasts per altitude 306*e*, and the result of step 414 to calculate maximum operating velocity over ground (e.g., $V_{mog}$) for an escape direction. Maximum operating velocity over ground is equal to the sum of maximum operating velocity and velocity of the wind, where wind velocity is positive if there is a tailwind and negative if there is a headwind, and is calculated per altitude. For example, if maximum operating velocity is 390 MPH and there is a tailwind at 35 MPH, then maximum operating velocity over ground is 425 MPH. For the same example but with a headwind, maximum operating velocity over ground is 355 MPH.

Step 418 uses the results of step 414 and step 416 to determine the distance traveled over ground. For example, if maximum operating velocity over ground is 425 MPH and the time to descend to the altitude threshold is 4.17 minutes, then aircraft traveled approximately 29.5 miles over the ground.

Steps 414, 416, and 418 are dependent on altitude, and therefore are generally calculated for a plurality of altitudes in block 420. In one example, block 420 uses 1,000 feet altitude increments for each determination.

Block 422 uses the results of block 420, such as the different distances from step 418, along with the cruise altitude and the altitude threshold, and calculates descent gradients for a plurality of positions along each segment from step 410. Block 422 starts its calculations at the beginning of the segment and moves along the segment in, for example, fixed increments until it reaches the end.

Step 424 uses minimum obstacle clearance per region 306*g* and terrain data 306*h* to calculate the lowest altitude the aircraft can fly above the terrain feature. The region used here overlays the region in region(s) of interest 306*b*. For example, if a minimum obstacle clearance threshold is 2,000 feet and the terrain feature is 11,000 feet, then the aircraft must fly at an altitude of at least 13,000 feet.

Step 426 uses the results of block 422 and step 424 to determine if any of the descent gradients along the segment collide with the terrain feature or infringe the minimum obstacle clearance threshold. Direct-to determination subsystem 304 operations are repeated until a modified flight path is determined. In some cases, all segments overlap the great circle flight path (which is the optimal flight path) and the modified flight path is the great circle flight path.

For example, if in step 426 at least one of the descent gradients of the segment collides with the terrain feature or infringes the minimum obstacle clearance threshold, then in step 428*a* the segment is moved a fixed increment away from great circle origin (e.g., in the safe descent direction) and destination 306*a* flight path and direct-to determination subsystem 304 operations are repeated as described above. But, if in step 426 all the descent gradients of the segment do not collide with the terrain feature or infringe minimum obstacle clearance threshold, then in step 428*b* the segment is moved a fixed increment closer to great circle origin and destination 306*a* flight path and direct-to determination subsystem 304 operations are repeated as described above. The fixed incremented may be in terms of, for example, miles, or degrees of latitude and/or longitude, or the like. Notably, this generally has the effect of shortening the overall flight path and making it more efficient, as described above, and as illustrated in more detail below with respect to FIGS. 5 and 6.

If the results of direct-to determination subsystem 304 operations for a segment are fluctuating between step 428*a* and step 428*b*, the segment at issue can be moved a lesser increment to or from the great circle flight path until the process in block 430 finds a better optimal solution. Additionally, the latest results of step 428*b* can be used as the solution. This process is repeated for all segments in block 430.

Example Modified Flight Paths

Figure 5:
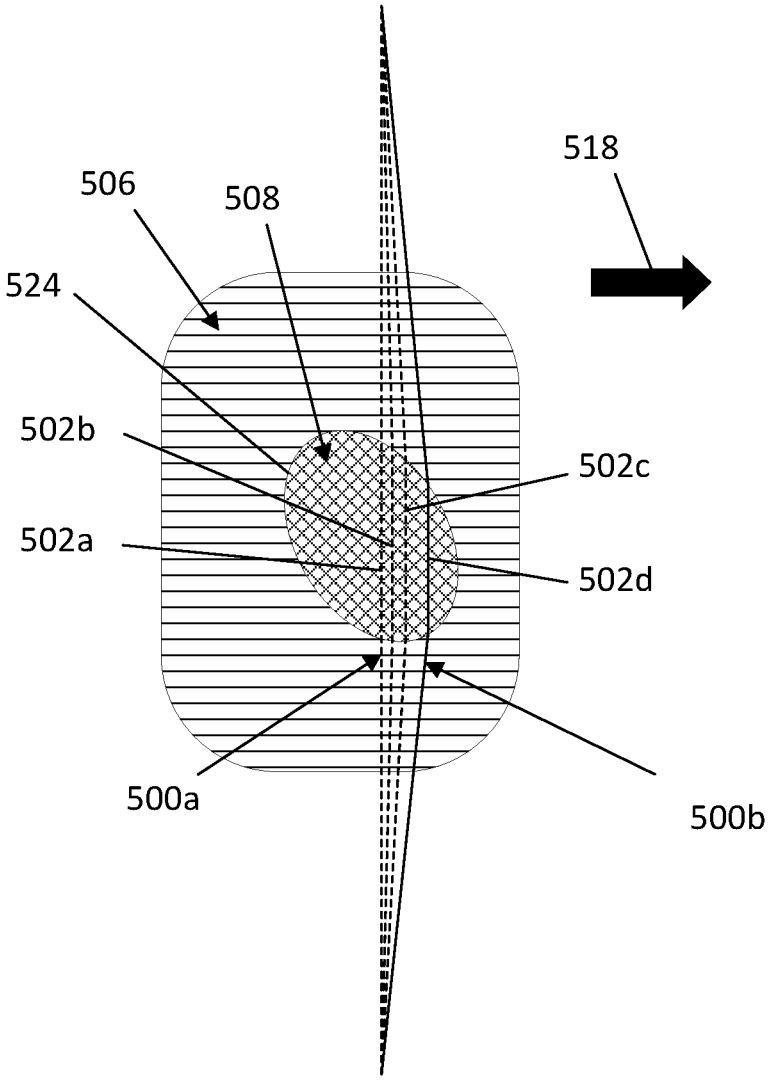
FIG. 5 depicts an overhead view of a flight planning process used to determine a modified flight path, and is the result of the process described in FIG. 4.

FIG. 5 depicts an overhead view of a flight planning process used to determine a modified flight path 500*b*, and is the result of the process described in FIG. 4.

In this example, an initial flight path 500*a* traverses a region of interest 506 when it intersects an elevation threshold line 524, creating a first segment 502*a*. Elevation threshold line 524 bounds a high terrain region 508. Here, initial flight path 500*a* is a great circle flight path, but in other examples may be based on an alternative initial flight path generating technique. At least one descent gradient for first segment 502*a* collides with a terrain feature or infringes a minimum obstacle clearance threshold. Thus, first segment 502*a* is then moved incrementally away from the great circle flight path (e.g., initial flight path 500*a*) towards escape direction 518 and becomes a second segment 502*b*.

The same process is repeated for second segment 502*b* and a third segment 502*c* and so forth, until an nth segment 502*d* is found with descent gradients that do not collide with the terrain feature or infringe the minimum obstacle clearance threshold, resulting in a modified flight path 500*b*. In some examples, modified flight path 500*b* may be determined before nth segment 502*d*. In another example where initial flight path 500*a* is not the great circle flight path, the descent gradients of first segment 502*a* do not collide with the terrain feature or infringe the minimum obstacle clearance threshold. Thus, first segment 502*a* is moved closer to the great circle flight path and the process is repeated until a better optimal solution is found.

In other examples, segments are defined as connecting a plurality of waypoints that are independent of elevation threshold line 524. However, the same flight planning process is used to determine the modified flight path.

FIG. 6 depicts an overhead view of various flight paths over or near a high terrain region and presents a result of direct-to subsystem 304 in FIG. 4.

In this example, an aircraft 604 is near a high terrain region, which comprises a safe flight area 624 and an unsafe flight area 626. Safe flight area 624 is the region above an elevation threshold where all descent gradients do not collide with the terrain feature or infringe the minimum obstacle clearance threshold. Unsafe flight area 626 is the region above the elevation threshold where at least one descent gradient collides with a terrain feature or infringes a minimum obstacle clearance threshold, and therefore is unsafe for aircraft 604 to traverse.

In this example, three flight paths are presented. A great circle flight path 600*a*, as described above, is the most direct route to the destination. In this example, great circle flight path 600*a* is also an initial flight path (as described in steps 408 and 410 in FIG. 4), but may only be an initial flight path (and not a great circle flight path) in other examples. Although not shown, unsafe flight area 626 may extend north beyond great circle flight path 600*a*, but here the safe descent direction is south-westerly, so the safe and unsafe flight areas are depicted in that direction. Thus, aircraft 604 cannot fly great circle flight path 600*a* because, in this example, aircraft 604 traverses unsafe flight area 626 and a safe descent is not possible from all parts of the flight path.

A conventional way of solving the issues of great circle flight path 600*a* is to divert the flight path around the entire area to avoid flying over the high terrain region altogether. The result is a conventional flight path 600*c*, which avoids traversing any part of unsafe flight area 626 and safe flight area 624, adding distance, time, and cost to the flight.

An improved method for determining an alternative flight path is to use environmental conditions and aircraft data (e.g., factors affecting flight 306 in FIG. 4) to determine an equally safe, but more direct flight path. This is accomplished by evaluating the descent gradients originating from a cruise altitude at the flight path in question and ensuring all descent gradients originate outside of unsafe flight area 626.

Descent gradients are evaluated for a plurality of positions along each segment of the flight path, such as a first segment 602*a* and a second segment 602*b*, which are defined by a plurality of waypoints. If at least one descent gradient for either segment originates in unsafe descent zone 626, the segment is moved as described in block 430 of FIG. 4.

The result of this process is a modified flight path 600*b*, which is an improvement over conventional flight path 600*c* because it is more direct and thus shorter. In this example, modified flight path 600*b* traverses safe flight area 624 while avoiding unsafe flight area 626, and is an embodiment of a resulting flight plan from FIG. 3 (e.g., flight plan 302).

Areas 624 and 626 are bounded by an elevation threshold line 624*a* and an unsafe threshold line 626*a*, respectively. Elevation threshold line 624*a* is fixed for a region (similar to elevation threshold line 224 from FIG. 2B) and unsafe threshold line 626*a* is dependent on environmental conditions and aircraft data (e.g., factors affecting flight 306 from FIG. 4). Therefore, unsafe threshold line 626*a* is variable for each high terrain region based on conditions, which further improves the safety of the methods for determining flight paths described herein.

For example, when flying a descent gradient to the southwest, northward winds 628 results in a headwind for the aircraft. Headwinds decrease the maximum operating velocity over ground and therefore decreases the distance aircraft 604 can travel over the ground during descent gradient (similar to step 418 in FIG. 4) given a maximum safe rate of descent. This shifts unsafe threshold line 626*a* closer to elevation threshold line 624*a*. Conversely, southward winds 630 results in a tailwind and increase the distance aircraft 604 can travel over the ground given the maximum safe rate of descent, shifting unsafe threshold line 626*a* further from elevation threshold line 624*a*. Notably, modified flight path 600*b* is between elevation threshold line 624*a* and unsafe threshold line 626*a* for parts of the flight path, and furthermore, is between the initial flight path 600*a* and conventional flight path 600*c*.

Figure 7:
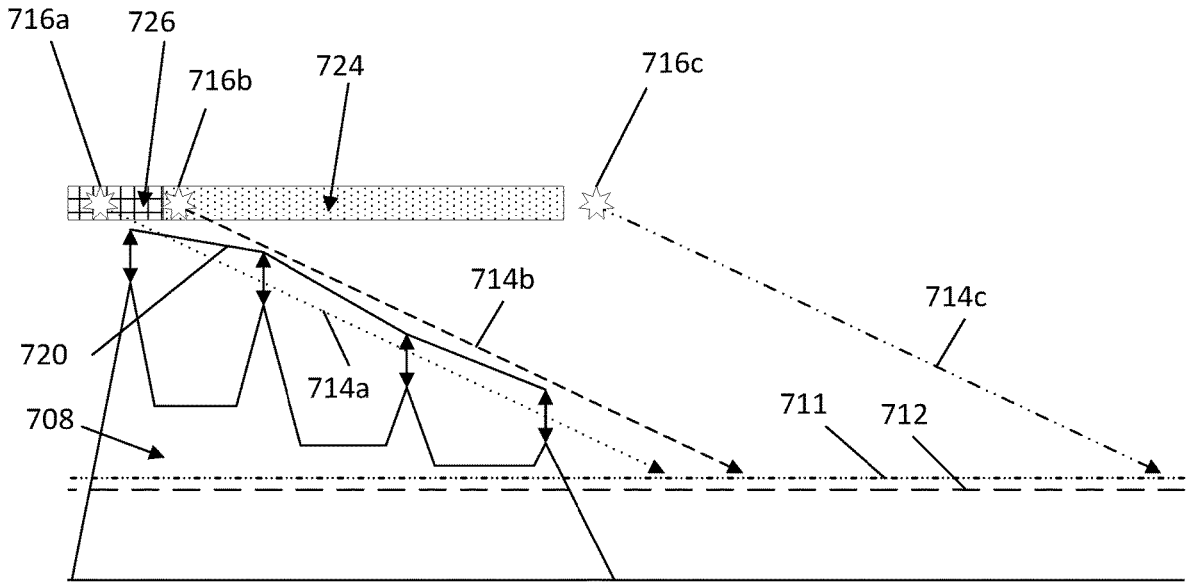
FIG. 7 depicts a view of various descent gradients from a cruising altitude to an altitude threshold over or near a high terrain region.

FIG. 7 depicts a view of various descent gradients (714*a*-*c*) from a cruising altitude to an altitude threshold 711 over or near a high terrain region 708.

In this example, an aircraft is flying a flight path when an unexpected event 716*a* occurs and the aircraft must make a rapid descent. The route to altitude threshold 711 is unsafe for descent gradient 714*a* because it infringes a minimum obstacle clearance threshold as denoted by a minimum obstacle clearance line 720. Therefore, the corresponding flight path is unsafe and as shown traverses an unsafe flight area 726.

Furthermore, a conventional descent gradient 714*c* originates at an unexpected event 716*c*, which occurs on a conventional flight path outside of areas 726 and 724, and a modified descent gradient 714*b* originates at an unexpected event 716*b*, which occurs on a flight path that traverses a safe flight area 724. Areas 726 and 724 denote regions with terrain above an elevation threshold 712, as previously discussed in FIG. 6. In both descent gradients 714*b* and 714*c* the aircraft safely descends to altitude threshold 711.

In this example, the most direct flight path traverses unsafe flight area 726 (similar to great circle flight path 600*a* in FIG. 6). The flight path corresponding to unexpected event 716*b* is a modified flight path (e.g., modified flight path 600*b* from FIG. 6) and is the result of the flight planning process discussed in FIGS. 4-6. Notably, the modified flight path is as close to the most direct flight path as safely possible while remaining in safe flight area 724. Thus, the resulting modified descent gradient 714*b* comes close to, but does not infringe, the minimum obstacle clearance threshold.

In other examples, modified descent gradient 714*b* originates at a cruise altitude at any location within safe flight area 724. In this example, areas 726 and 724 represent potential flight path areas at a certain altitude and may be represented differently in other examples.

Example Emergency Destinations Determination

FIG. 8 depicts a flowchart of various aspects and operations of an embodiment of the emergency destinations determination subsystem 310, previously depicted in FIG. 3, including inputs such as factors affecting landing 312.

In this example, step 816 uses descent gradient(s) 814 and airport(s) information 312*a* to identify a list of emergency destinations within a threshold distance (e.g., a radius) from an aircraft. Descent gradient(s) 814 is a plurality of descent gradients originating from a cruise altitude of a flight path and airport(s) information 312*a* is a listing of all airports. Thus, step 816 identifies airports within range of the aircraft at different positions along the flight path and descent gradients, and will change with the aircraft's position. In some examples, a modified flight path is used as the flight path, and thus step 816 calculates the distance from the modified flight path to the one or more emergency destinations.

In this example, step 818 uses airport visibility reports 312*b* and the airport list from step 816 to filter out emergency destinations that do not have sufficient visibility for a Visual Flight Rules (VFR) landing from the list in step 816. In other examples where an aircraft is not required to land in VFR conditions, for example in instrument flight rules conditions, step 818 is not used or is bypassed.

Step 820 uses airport wind reports 312*c*, such as wind speed and direction, and the airport list from step 818 to filter out emergency destinations with wind conditions that are too difficult for an aircraft to land. For example, a crosswind of 33-40 mph or more can prevent certain aircraft from landing. The thresholds for wind conditions depend on several factors including the aircraft type or model and runway conditions (e.g., wet or dry).

Step 822 uses weather data 312*d*, such as actual winds in the air, and the airport list from step 820 to filter out emergency destinations that are out of range of the aircraft given a time threshold for flight time. The time threshold is generally an amount of time the aircraft can travel after completing an emergency descent, and in some examples is no more than approximately 30 minutes. In some examples, the time threshold is determined using additional information from a direct-to determination subsystem (e.g., direct-to determination subsystem 304 in FIG. 4), such as maximum operating velocity.

In this example, after steps 816, 818, 820, and 822 are complete, emergency destinations determination subsystem 310 provides a list of suitable emergency destinations to be used in a flight plan (e.g., flight plan 302 in FIG. 3). Emergency destinations determination subsystem 310 may be part of an integral flight planning software suite or may operate independently of flight planning software on mobile equipment, such as laptop or tablet computers, or other computing devices that may be moved from place to place. In some examples, emergency destinations determination subsystem 310 provides the list of destinations to a pilot through a flight management system. In other examples, the pilot selects one of the suitable emergency destinations and information on the aircraft, such as current aircraft position, aircraft health status, estimated arrival time, and requested priority upon arrival, is sent to the selected airport.

FIG. 9 depicts a flight path 900 near high elevation terrain features with a safe descent gradient to several landing sites.

In this example, an aircraft 904 is flying flight path 900 through safe flight area 624 (and out of unsafe flight area 626) when an unexpected event 916 occurs. Aircraft 904 then turns to its right (in a safe descent direction) and descends along a descent gradient 914 to an altitude threshold, as described above. Once aircraft 904 reaches the altitude threshold, aircraft 904 may only want to travel a limited range within an emergency descent region 932 before landing (e.g., as described in emergency destinations determination subsystem 310 of FIG. 8).

Here, emergency descent region 932 is a radius taken from aircraft's 904 location at an altitude threshold, but in other examples may be taken from any position on the flight path or descent gradient. However, aircraft's 904 range is affected by wind conditions, such as wind speed and direction, and shape of emergency descent region 932 varies based on aircraft's 904 range and may not be an exact circle. For example, a northward winds 928 results in a headwind for aircraft 904 during descent gradient 914 and decreases the area of emergency descent region 932 in the direction the wind is blowing, such as in this example. Conversely, southward winds would increase the area of emergency descent region 932 in the direction the wind is blowing.

In this example, emergency destination region 932 comprises suitable emergency destinations and unsuitable emergency destinations (e.g., a suitable emergency destination 934 and an unsuitable emergency destination 936). The suitable emergency destinations are sites where aircraft 904 can safely land, and the unsuitable emergency destinations are sites where aircraft 904 cannot safely land. In one example, the suitable emergency destinations are provided by step 822 of FIG. 8 and the unsuitable emergency destinations are the remaining emergency destinations from step 816 of FIG. 8.

Figure 10:
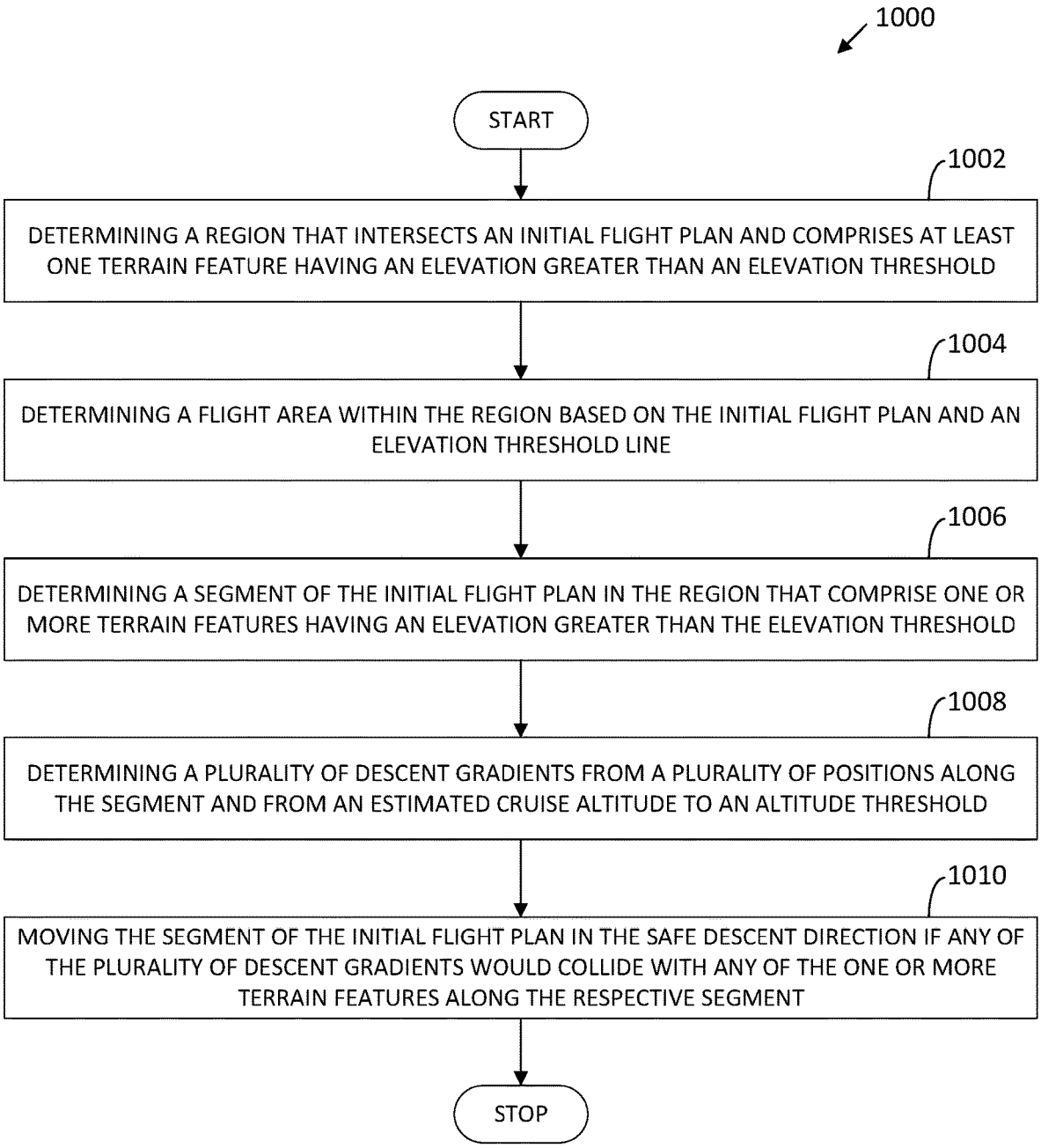
FIG. 10 depicts an example method for determining a flight plan from an origin to a destination for an aircraft.

Example of Methods Determining Flight Plans Over or Near High Elevation Terrain Features FIG. 10 depicts an example method 1000 for determining a flight plan from an origin to a destination for an aircraft.

Method 1000 begins at step 1002 with determining a region that intersects an initial flight path and comprises at least one terrain feature having an elevation greater than an elevation threshold.

Method 1000 then proceeds to step 1004 with determining a flight area within the region based on the initial flight path and an elevation threshold line. In some embodiments, the elevation threshold line indicates a portion of the respective region in which all terrain is below the elevation threshold in a safe descent direction for the region.

Method 1000 then proceeds to step 1006 with determining a segment of the initial flight path in the region that comprise one or more terrain features having an elevation greater than the elevation threshold.

Method 1000 then proceeds to step 1008 with determining a plurality of descent gradients from a plurality of positions along the segment and from an estimated cruise altitude to an altitude threshold. In some embodiments, the descent gradients are determined based on an estimated descent time from the estimated cruise altitude to the altitude threshold.

Method 1000 then proceeds to step 1010 with moving the segment of the initial flight path in the safe descent direction if any of the plurality of descent gradients would collide with any of the one or more terrain features along the respective segment.

In some embodiments, the modified flight path for the region is between the initial flight path and the elevation threshold line within the flight area of the respective region.

Some embodiments of method 1000 further include determining if any of the plurality of descent gradients would collide with any of the one or more terrain features along the respective segment based on one or more of: a wind direction and wind speed for a plurality of altitudes between the estimated cruise altitude and the altitude threshold; and a maximum operating velocity for the aircraft across the ground for each of the plurality of altitudes.

Some embodiments of method 1000 further include moving the segment of the initial flight path in the safe descent direction if any of the plurality of descent gradients would infringe a minimum obstacle clearance threshold associated with any of the one or more terrain features along the segment.

Some embodiments of method 1000 further include providing the modified flight path to the aircraft.

Some embodiments of method 1000 further include determining one or more emergency destinations based on the modified flight path and a safe descent direction for the respective region relative to the modified flight path. In some embodiments, the one or more emergency destinations are determined based on one or more of: wind conditions at the one or more emergency destinations; visibility conditions at the one or more emergency destinations; weather conditions at the one or more emergency destinations; distance from the modified flight path to the one or more emergency destinations; or runway lengths at the one or more emergency destinations.

Some embodiments of method 1000 further include receiving an updated wind direction and updated wind speed for the plurality of altitudes between an actual cruise altitude and the altitude threshold; and determining the maximum operating velocity for the aircraft across the ground for each of the plurality of altitudes.

In some embodiments of method 1000, the estimated descent time is based on a maximum safe vertical speed for the aircraft.

In some embodiments of method 1000, the initial flight path is determined according to a great circle flight path between the origin and the destination.

In some embodiments of method 1000, the elevation threshold is equal to or less than 10,000 feet. In some embodiments, the elevation threshold accounts for a minimum obstacle clearance.

Notably, method 1000 is just an example of certain aspects of the present disclosure, and fewer and/or other aspects may be present in other methods consistent with the present disclosure.

Example Processing System

Figure 11:
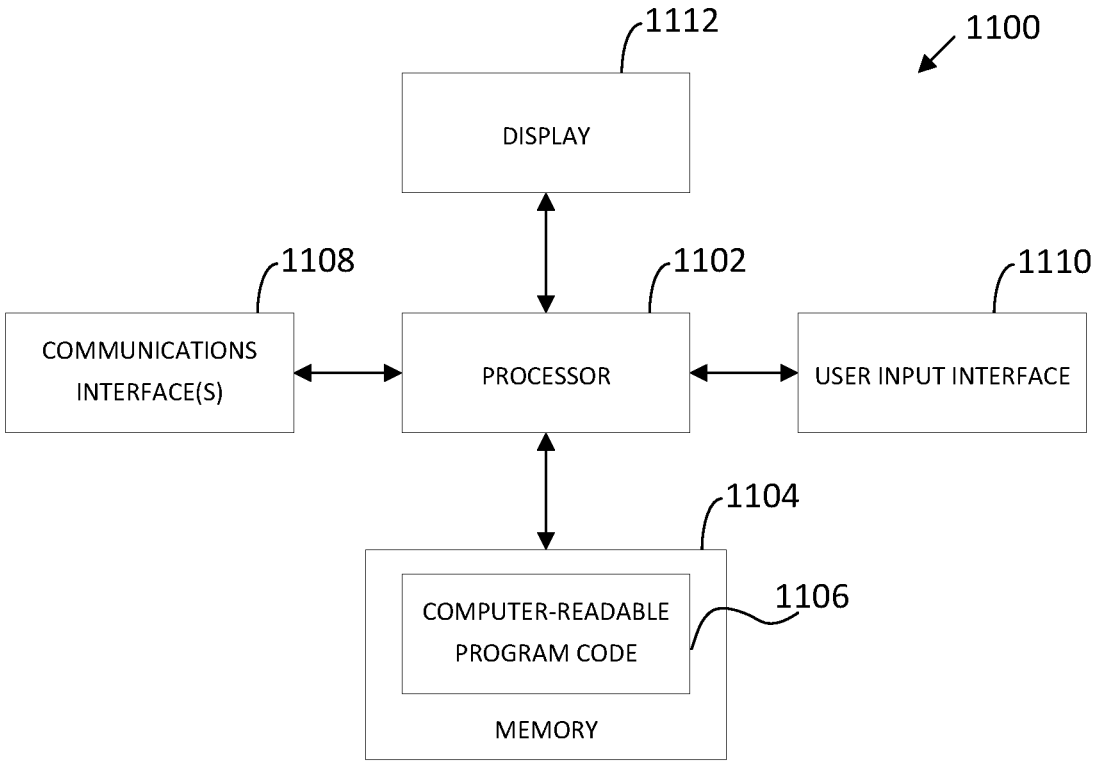
FIG. 11 depicts an example processing system for a system for developing a flight plan for an aircraft.

FIG. 11 depicts an example processing system 1100 for a system for developing a flight plan for an aircraft. Generally, an apparatus of exemplary implementations of the present disclosure may comprise, include or be embodied in one or more fixed or portable electronic devices. Examples of suitable electronic devices include a smartphone, tablet computer, laptop computer, desktop computer, workstation computer, server computer or the like. The apparatus may include one or more of each of a number of components such as, for example, processor 1102 (e.g., processing circuitry) connected to a memory 1104 (e.g., storage device). In some examples, the apparatus 1100 implements the systems and methods described herein in order to perform enhanced flight planning as described above with respect to FIGS. 2A-10.

The processor 1102 may be composed of one or more processors alone or in combination with one or more memories. The processor is generally any piece of computer hardware that is capable of processing information such as, for example, data, computer programs and/or other suitable electronic information. The processor is composed of a collection of electronic circuits some of which may be packaged as an integrated circuit or multiple interconnected integrated circuits (an integrated circuit at times more commonly referred to as a "chip"). The processor may be configured to execute computer programs, which may be stored onboard the processor or otherwise stored in the memory 1106 (of the same or another apparatus).

The processor 1102 may be a number of processors, a multi-core processor or some other type of processor, depending on the particular implementation. Further, the processor may be implemented using a number of heterogeneous processor systems in which a main processor is present with one or more secondary processors on a single chip. As another illustrative example, the processor may be a symmetric multi-processor system containing multiple processors of the same type. In yet another example, the processor may be embodied as or otherwise include one or more application-specific integrated circuits (ASICs), field-programmable gate arrays (FPGAs) or the like. Thus, although the processor may be capable of executing a computer program to perform one or more functions, the processor of various examples may be capable of performing one or more functions without the aid of a computer program. In either instance, the processor may be appropriately programmed to perform functions or operations according to example implementations of the present disclosure.

The memory 1104 is generally any piece of computer hardware that is capable of storing information such as, for example, data, computer programs (e.g., computer-readable program code 1106) and/or other suitable information either on a temporary basis and/or a permanent basis. The memory may include volatile and/or non-volatile memory, and may be fixed or removable. Examples of suitable memory include random access memory (RAM), read-only memory (ROM), a hard drive, a flash memory, a thumb drive, a removable computer diskette, an optical disk, a magnetic tape or some combination of the above. Optical disks may include compact disk-read only memory (CD-ROM), compact disk-read/write (CD-R/W), DVD or the like. In various instances, the memory may be referred to as a computer-readable storage medium. The computer-readable storage medium is a non-transitory device capable of storing information, and is distinguishable from computer-readable transmission media such as electronic transitory signals capable of carrying information from one location to another. Computer-readable medium as described herein may generally refer to a computer-readable storage medium or computer-readable transmission medium.

In addition to the memory 1104, the processor 1102 may also be connected to one or more interfaces for displaying, transmitting and/or receiving information. The interfaces may include a communications interface 1108 (e.g., communications unit) and/or one or more user interfaces. The communications interface may be configured to transmit and/or receive information, such as to and/or from other apparatus(es), network(s) or the like. The communications interface may be configured to transmit and/or receive information by physical (wired) and/or wireless communications links. Examples of suitable communication interfaces include a network interface controller (NIC), wireless NIC (WNIC) or the like.

The user interfaces may include a display 1112 and/or at least one user input interface 1110 (e.g., input/output unit). The display may be configured to present or otherwise display information to a user, suitable examples of which include a liquid crystal display (LCD), light-emitting diode display (LED), plasma display panel (PDP) or the like. The user input interfaces may be wired or wireless, and may be configured to receive information from a user into the apparatus, such as for processing, storage and/or display. Suitable examples of user input interfaces include a microphone, keyboard or keypad, joystick, touch-sensitive surface (separate from or integrated into a touchscreen), biometric sensor or the like. The user interfaces may further include one or more interfaces for communicating with peripherals such as printers, scanners or the like. In some examples, the user interfaces include a graphical user interface (GUI).

As indicated above, program code instructions may be stored in memory, and executed by processor that is thereby programmed, to implement functions of the systems, subsystems, tools and their respective elements described herein. As will be appreciated, any suitable program code instructions may be loaded onto a computer or other programmable apparatus from a computer-readable storage medium to produce a particular machine, such that the particular machine becomes a means for implementing the functions specified herein. These program code instructions may also be stored in a computer-readable storage medium that can direct a computer, a processor or other programmable apparatus to function in a particular manner to thereby generate a particular machine or particular article of manufacture. The instructions stored in the computer-readable storage medium may produce an article of manufacture, where the article of manufacture becomes a means for implementing functions described herein. The program code instructions may be retrieved from a computer-readable storage medium and loaded into a computer, processor or other programmable apparatus to configure the computer, processor or other programmable apparatus to execute operations to be performed on or by the computer, processor or other programmable apparatus.

Retrieval, loading and execution of the program code instructions may be performed sequentially such that one instruction is retrieved, loaded and executed at a time. In some example implementations, retrieval, loading and/or execution may be performed in parallel such that multiple instructions are retrieved, loaded, and/or executed together. Execution of the program code instructions may produce a computer-implemented process such that the instructions executed by the computer, processor or other programmable apparatus provide operations for implementing functions described herein.

Execution of instructions by a processor, or storage of instructions in a computer-readable storage medium, supports combinations of operations for performing the specified functions. In this manner, an apparatus 1100 may include a processor 1102 and a computer-readable storage medium or memory 1104 coupled to the processor 1102, where the processor 1102 is configured to execute computer-readable program code 1106 stored in the memory 1104. It will also be understood that one or more functions, and combinations of functions, may be implemented by special purpose hardware-based computer systems and/or processors which perform the specified functions, or combinations of special purpose hardware and program code instructions.

Example Clauses

Clause 1: A method for determining a flight plan from an origin to a destination for an aircraft, comprising: determining one or more regions that intersect an initial flight path and comprise at least one terrain feature having an elevation greater than an elevation threshold; for each respective region in the one or more regions: determining a flight area within the respective region based on the initial flight path and an elevation threshold line, wherein the elevation threshold line indicates a portion of the respective region in which all terrain is below the elevation threshold in a safe descent direction for the respective region; determining one or more segments of the initial flight path in the respective region that comprise one or more terrain features having an elevation greater than the elevation threshold; and determining a modified flight path for each respective segment of the one or more segments of the initial flight path in the respective region by: determining a plurality of descent gradients from a plurality of positions along the respective segment and from an estimated cruise altitude to an altitude threshold based on an estimated descent time from the estimated cruise altitude to the altitude threshold; and moving the respective segment of the initial flight path in the safe descent direction if any of the plurality of descent gradients would collide with any of the one or more terrain features along the respective segment, wherein the modified flight path for the respective region is between the initial flight path and the elevation threshold line within the flight area of the respective region.

Clause 2: The method of Clause 1, further comprising: determining if any of the plurality of descent gradients would collide with any of the one or more terrain features along the respective segment based on: a wind direction and wind speed for a plurality of altitudes between the estimated cruise altitude and the altitude threshold; and a maximum operating velocity for the aircraft across the ground for each of the plurality of altitudes.

Clause 3. The method of any one of Clauses 1-2, further comprising: for each respective segment of the one or more segments of the initial flight path in the respective region: moving the respective segment of the initial flight path in the safe descent direction if any of the plurality of descent gradients would infringe a minimum obstacle clearance threshold associated with any of the one or more terrain features along the respective segment.

Clause 4. The method of any one of Clauses 1-3, wherein the estimated descent time is based on a maximum safe vertical speed for the aircraft.

Clause 5. The method of any one of Clauses 1-4, wherein the initial flight path is determined according to a great circle flight path between the origin and the destination.

Clause 6. The method of any one of Clauses 1-5, wherein the elevation threshold is in the range of 8,000 to 10,000 feet.

Clause 7. The method of any one of Clauses 1-6, further comprising: providing the modified flight path to the aircraft.

Clause 8. The method of any one of Clauses 1-7, further comprising: for each respective region in the one or more regions: determining one or more emergency destinations based on the modified flight path and a safe descent direction for the respective region relative to the modified flight path.

Clause 9. The method of Clause 8, wherein the one or more emergency destinations are determined based on one or more of: wind conditions at the one or more emergency destinations; visibility conditions at the one or more emergency destinations; weather conditions at the one or more emergency destinations; distance from the modified flight path to the one or more emergency destinations; or runway lengths at the one or more emergency destinations.

Clause 10. The method of any one of Clauses 1-9, further comprising: receiving an updated wind direction and updated wind speed for the plurality of altitudes between an actual cruise altitude and the altitude threshold; and determining the maximum operating velocity for the aircraft across the ground for each of the plurality of altitudes.

Clause 11. A processing system, comprising: a memory comprising computer-executable instructions; one or more processors configured to execute the computer-executable instructions and cause the processing system to: determine one or more regions that intersect an initial flight path and comprise at least one terrain feature having an elevation greater than an elevation threshold; for each respective region in the one or more regions: determine a flight area within the respective region based on the initial flight path and an elevation threshold line, wherein the elevation threshold line indicates a portion of the respective region in which all terrain is below the elevation threshold in a safe descent direction for the respective region; determine one or more segments of the initial flight path in the respective region that comprise one or more terrain features having an elevation greater than the elevation threshold; and determine a modified flight path for each respective segment of the one or more segments of the initial flight path in the respective region by: determine a plurality of descent gradients from a plurality of positions along the respective segment and from an estimated cruise altitude to an altitude threshold based on an estimated descent time from the estimated cruise altitude to the altitude threshold; and move the respective segment of the initial flight path in the safe descent direction if any of the plurality of descent gradients would collide with any of the one or more terrain features along the respective segment, wherein the modified flight path for the respective region is between the initial flight path and the elevation threshold line within the flight area of the respective region.

Clause 12. The processing system of Clause 11, wherein the one or more processors are further configured to cause the processing system to: determine if any of the plurality of descent gradients would collide with any of the one or more terrain features along the respective segment based on: a wind direction and wind speed for a plurality of altitudes between the estimated cruise altitude and the altitude threshold; and a maximum operating velocity for the aircraft across the ground for each of the plurality of altitudes.

Clause 13. The processing system of any one of Clauses 11-12, wherein the one or more processors are further configured to cause the processing system, for each respective segment of the one or more segments of the initial flight path in the respective region, to: move the respective segment of the initial flight path in the safe descent direction if any of the plurality of descent gradients would infringe a minimum obstacle clearance threshold associated with any of the one or more terrain features along the respective segment.

Clause 14. The processing system of any one of Clauses 11-13, wherein the estimated descent time is based on a maximum safe vertical speed for the aircraft;

Clause 15. The processing system of any one of Clauses 11-14, wherein the initial flight path is determined according to a great circle flight path between the origin and the destination.

Clause 16. The processing system of any one of Clauses 11-15, wherein the one or more processors are further configured to cause the processing system to: provide the modified flight path to the aircraft.

Clause 17. The processing system of any one of Clauses 11-16, wherein the one or more processors are further configured to cause the processing system, for each respective region in the one or more regions, to: determine one or more emergency destinations based on the modified flight path and a safe descent direction for the respective region relative to the modified flight path.

Clause 18. The processing system of Clause 17, wherein the one or more emergency destinations are determined based on one or more of: wind conditions at the one or more emergency destinations; visibility conditions at the one or more emergency destinations; weather conditions at the one or more emergency destinations; distance from the modified flight path to the one or more emergency destinations; or runway lengths at the one or more emergency destinations.

Clause 19. The processing system of any one of Clauses 11-18, wherein the one or more processors are further configured to cause the processing system to: receive an updated wind direction and updated wind speed for the plurality of altitudes between an actual cruise altitude and the altitude threshold; and determine the maximum operating velocity for the aircraft across the ground for each of the plurality of altitudes.

Clause 20. A non-transitory computer readable medium comprising computer-executable instructions that, when executed by a processing system, cause the processing system to perform a method for determining a flight plan from an origin to a destination for an aircraft, the method comprising: determining one or more regions that intersect an initial flight path and comprise at least one terrain feature having an elevation greater than an elevation threshold; for each respective region in the one or more regions: determining a flight area within the respective region based on the initial flight path and an elevation threshold line, wherein the elevation threshold line indicates a portion of the respective region in which all terrain is below the elevation threshold in a safe descent direction for the respective region; determining one or more segments of the initial flight path in the respective region that comprise one or more terrain features having an elevation greater than the elevation threshold; and determining a modified flight path for each respective segment of the one or more segments of the initial flight path in the respective region by: determining a plurality of descent gradients from a plurality of positions along the respective segment and from an estimated cruise altitude to an altitude threshold based on an estimated descent time from the estimated cruise altitude to the altitude threshold; and moving the respective segment of the initial flight path in the safe descent direction if any of the plurality of descent gradients would collide with any of the one or more terrain features along the respective segment, wherein the modified flight path for the respective region is between the initial flight path and the elevation threshold line within the flight area of the respective region.

Additional Considerations

The descriptions of the various aspects of the present invention have been presented for purposes of illustration, but are not intended to be exhaustive or limited to the aspects disclosed. Many modifications and variations will be apparent to those of ordinary skill in the art without departing from the scope and spirit of the described aspects. The terminology used herein was chosen to best explain the principles of the aspects, the practical application or technical improvement over technologies found in the marketplace, or to enable others of ordinary skill in the art to understand the aspects disclosed herein.

While the foregoing is directed to aspects of the present invention, other and further aspects of the invention may be devised without departing from the basic scope thereof, and the scope thereof is determined by the claims that follow.

What is claimed is:

1. A method for determining a flight plan from an origin to a destination for an aircraft, comprising:

determining, during a flight of the aircraft, one or more regions that intersect an initial flight path and comprise at least one terrain feature having an elevation greater than an elevation threshold;

for each respective region in the one or more regions:

determining a flight area within the respective region based on the initial flight path and an elevation threshold line, wherein the elevation threshold line indicates a portion of the respective region in which all terrain is below the elevation threshold in a safe descent direction for the respective region;

determining one or more segments of the initial flight path in the respective region that comprise one or more terrain features having an elevation greater than the elevation threshold; and determining a modified flight path for each respective segment of the one or more segments of the initial flight path in the respective region by:

determining a plurality of descent gradients from a plurality of positions along the respective segment and from an estimated cruise altitude to an altitude threshold based on an estimated descent time from the estimated cruise altitude to the altitude threshold; and moving the respective segment of the initial flight path in the safe descent direction if any of the plurality of descent gradients would collide with any of the one or more terrain features along the respective segment, wherein at least a portion of the modified flight path for the respective region is between the initial flight path and the elevation threshold line within the flight area of the respective region.

2. The method of claim 1, further comprising: determining if any of the plurality of descent gradients would collide with any of the one or more terrain features along the respective segment based on:

a wind direction and wind speed for a plurality of altitudes between the estimated cruise altitude and the altitude threshold; and a maximum operating velocity for the aircraft across the ground for each of the plurality of altitudes.

3. The method of claim 1, further comprising:

for each respective segment of the one or more segments of the initial flight path in the respective region:

moving the respective segment of the initial flight path in the safe descent direction if any of the plurality of descent gradients would infringe a minimum obstacle clearance threshold associated with any of the one or more terrain features along the respective segment.

4. The method of claim 1, wherein the estimated descent time is based on a maximum safe vertical speed for the aircraft.

5. The method of claim 1, wherein the initial flight path is determined according to a great circle flight path between the origin and the destination.

6. The method of claim 1, wherein the elevation threshold is in a range of 8,000 to 10,000 feet.

7. The method of claim 1, further comprising: providing the modified flight path to the aircraft.

8. The method of claim 1, further comprising:

for each respective region in the one or more regions:

determining one or more emergency destinations based on the modified flight path and a safe descent direction for the respective region relative to the modified flight path.

9. The method of claim 8, wherein the one or more emergency destinations are determined based on one or more of:

wind conditions at the one or more emergency destinations;

visibility conditions at the one or more emergency destinations;

weather conditions at the one or more emergency destinations;

distance from the modified flight path to the one or more emergency destinations; or runway lengths at the one or more emergency destinations.

10. The method of claim 1, further comprising:

receiving an updated wind direction and updated wind speed for the plurality of altitudes between an actual cruise altitude and the altitude threshold; and determining the maximum operating velocity for the aircraft across the ground for each of the plurality of altitudes.

11. A processing system, comprising:

a memory comprising computer-executable instructions;

one or more processors configured to execute the computer-executable instructions and cause the processing system to:

determine, during a flight of an aircraft, one or more regions that intersect an initial flight path and comprise at least one terrain feature having an elevation greater than an elevation threshold;

for each respective region in the one or more regions, the one or more processors cause the processing system to:

determine a flight area within the respective region based on the initial flight path and an elevation threshold line, wherein the elevation threshold line indicates a portion of the respective region in which all terrain is below the elevation threshold in a safe descent direction for the respective region;

determine one or more segments of the initial flight path in the respective region that comprise one or more terrain features having an elevation greater than the elevation threshold; and determine a modified flight path for each respective segment of the one or more segments of the initial flight path in the respective region, wherein to determine the modified flight path for each respective segment, the one or more processors cause the processing system to:

determine a plurality of descent gradients from a plurality of positions along the respective segment and from an estimated cruise altitude to an altitude threshold based on an estimated descent time from the estimated cruise altitude to the altitude threshold; and move the respective segment of the initial flight path in the safe descent direction if any of the plurality of descent gradients would collide with any of the one or more terrain features along the respective segment, wherein at least a portion of the modified flight path for the respective region is between the initial flight path and the elevation threshold line within the flight area of the respective region.

12. The processing system of claim 11, wherein the one or more processors are further configured to cause the processing system to:

determine if any of the plurality of descent gradients would collide with any of the one or more terrain features along the respective segment based on:

a wind direction and wind speed for a plurality of altitudes between the estimated cruise altitude and the altitude threshold; and a maximum operating velocity for the aircraft across the ground for each of the plurality of altitudes.

13. The processing system of claim 11, wherein the one or more processors are further configured to cause the processing system, for each respective segment of the one or more segments of the initial flight path in the respective region, to: move the respective segment of the initial flight path in the safe descent direction if any of the plurality of descent gradients would infringe a minimum obstacle clearance threshold associated with any of the one or more terrain features along the respective segment.

14. The processing system of claim 11, wherein the estimated descent time is based on a maximum safe vertical speed for the aircraft.

15. The processing system of claim 11, wherein the initial flight path is determined according to a great circle flight path between an origin and a destination.

16. The processing system of claim 11, wherein the one or more processors are further configured to cause the processing system to:

provide the modified flight path to the aircraft.

17. The processing system of claim 11, wherein the one or more processors are further configured to cause the processing system, for each respective region in the one or more regions, to: determine one or more emergency destinations based on the modified flight path and a safe descent direction for the respective region relative to the modified flight path.

18. The processing system of claim 17, wherein the one or more emergency destinations are determined based on one or more of:

wind conditions at the one or more emergency destinations;

visibility conditions at the one or more emergency destinations;

weather conditions at the one or more emergency destinations;

distance from the modified flight path to the one or more emergency destinations; or runway lengths at the one or more emergency destinations.

19. The processing system of claim 11, wherein the one or more processors are further configured to cause the processing system to:

receive an updated wind direction and updated wind speed for the plurality of altitudes between an actual cruise altitude and the altitude threshold; and determine the maximum operating velocity for the aircraft across the ground for each of the plurality of altitudes.

20. A non-transitory computer readable medium comprising computer-executable instructions that, when executed by a processing system, cause the processing system to perform a method for determining a flight plan from an origin to a destination for an aircraft, the method comprising:

determining, during a flight of the aircraft, one or more regions that intersect an initial flight path and comprise at least one terrain feature having an elevation greater than an elevation threshold;

for each respective region in the one or more regions:

determining a flight area within the respective region based on the initial flight path and an elevation threshold line, wherein the elevation threshold line indicates a portion of the respective region in which all terrain is below the elevation threshold in a safe descent direction for the respective region;

determining one or more segments of the initial flight path in the respective region that comprise one or more terrain features having an elevation greater than the elevation threshold; and determining a modified flight path for each respective segment of the one or more segments of the initial flight path in the respective region by:

determining a plurality of descent gradients from a plurality of positions along the respective segment and from an estimated cruise altitude to an altitude threshold based on an estimated descent time from the estimated cruise altitude to the altitude threshold; and moving the respective segment of the initial flight path in the safe descent direction if any of the plurality of descent gradients would collide with any of the one or more terrain features along the respective segment, wherein at least a portion of the modified flight path for the respective region is between the initial flight path and the elevation threshold line within the flight area of the respective region.

* * * * *